US005285608A

United States Patent [19]

Costello

[11] Patent Number: 5,285,608

[45] Date of Patent: Feb. 15, 1994

[54] DOOR

[76] Inventor: James Costello, 195 W. Hills Rd., Huntington, N.Y. 11746

[21] Appl. No.: 805,619

[22] Filed: Dec. 12, 1991

[51] Int. Cl.[5] ..... E06B 3/36

[52] U.S. Cl. ..... 52/456; 52/309.11

[58] Field of Search ..... 52/455, 456, 785, 309.11

[56] References Cited

U.S. PATENT DOCUMENTS

| | | | |
|---|---|---|---|
| 1,270,014 | 6/1918 | Conwell | 52/476 |
| 1,848,715 | 11/1928 | Hart et al. | 52/455 |
| 3,106,500 | 10/1963 | Turner | 52/785 |
| 4,152,876 | 5/1979 | Seely | 52/455 |
| 4,327,535 | 5/1982 | Governale | 52/309.11 |
| 4,546,585 | 10/1985 | Governale | 52/455 |
| 5,020,292 | 6/1991 | Strom et al. | 52/309.9 |

*Primary Examiner*—Carl D. Friedman
*Assistant Examiner*—Christopher T. Kent

[57] ABSTRACT

A door having an appearance of being entirely made of wood which is provided by panels of wood veneer adhesively secured to a core of thin gauge sheet metal panels. The sheet metal panels are adapted for this purpose by being imparted with horizontal and vertical fold lines which enable the panels to resist flexing and bending out of plane, to thereby contribute to anti-warping and other noteworthy features.

1 Claim, 1 Drawing Sheet

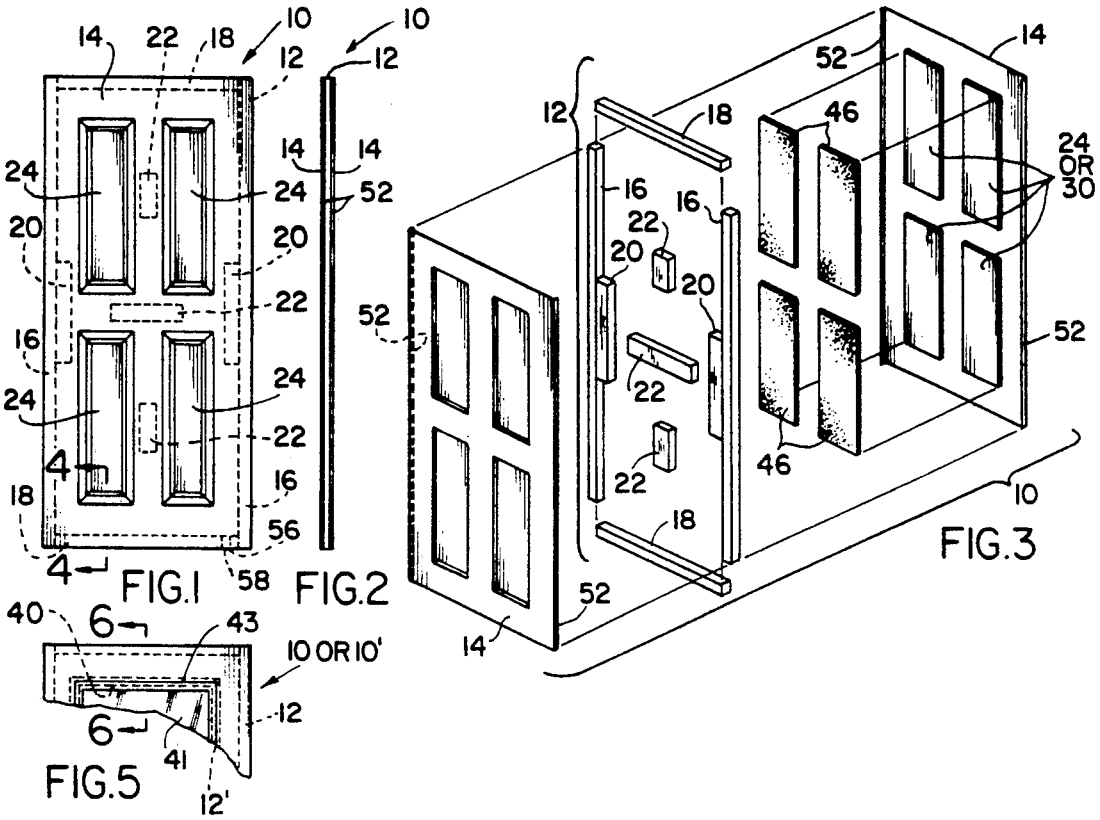
FIG.1
FIG.2
FIG.3
FIG.5
10 OR 10'
24 OR 30
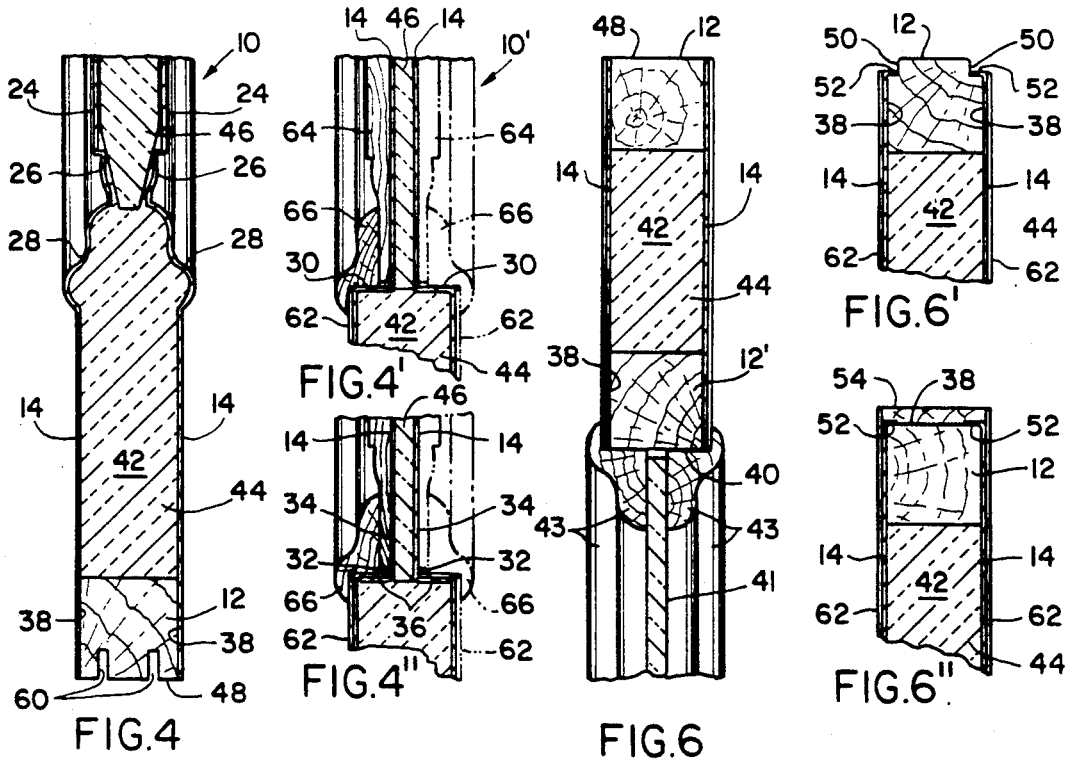
FIG.4
FIG.4'
FIG.4''
FIG.6
FIG.6'
FIG.6''

DOOR

The present invention relates to a door having an exterior appearance of an entirely wooden article of manufacture, but advantageously having an internal core of sheet metal construction material to contribute high structural strength, non-warping and fire-resistance characteristics, as well as other noteworthy attributes.

EXAMPLES OF THE PRIOR ART

For reinforcing or other like purposes, it is already well known to use internal cores in the construction of doors. In U.S. Pat. No. 4,704,834 issued on Nov. 10, 1987 to Turner, the suggested core is plywood, in U.S. Pat. No. 4,630,420 issued on Dec. 23, 1986 to Hagemeyer, the interior of the door is filled with foam, and as a further prior art example, in U.S. Pat. No. 3,899,860, issued on Aug. 19, 1975 to Newell, the core is comprised of compressed sawdust.

A core of "metal" would be a functionally better choice than the noted prior art core materials, but has heretofore not been used undoubtedly because of a prohibitive cost and added weight factor. Underlying the present invention is the recognition that "metal" in the specific form of thin gauge panels easily fabricated by die stamping and bending or forming, can advantageously be used as a door core and, although thin gauge sheet metal is not known for structural strength, can be easily adapted to possess this characteristic, all as will be discussed in greater detail subsequently herein.

Generally it is an object of the present invention to provide a wood-appearing metal core door overcoming the foregoing and other shortcomings of the prior art. More particularly, it is an object to embody bends along fold lines in strategic locations in door sheet metal core panels, along which fold lines the sheet metal construction material resists in use bending and flexing in the plane of the panels, and thus effectively functions as a strength-enhancing core for a door.

The description of the invention which follows, together with the accompanying drawings should not be construed as limiting the invention to the examples shown and described, because those skilled in the art to which this invention appertains will be able to devise other forms thereof within the ambit of the appended claims.

FIG. 1 is a front elevational view of a representative door having the appearance of a wooden article of manufacture and provided with such an appearance in according to the present invention, the rear elevational view being identical;

FIG. 2 is a side elevational view projected from FIG. 1;

FIG. 3 is an exploded perspective view of the door components in spaced relation to each other and incident to assembly;

FIG. 4 a cross sectional view taken along line 4—4 of FIG. 1;

FIG. 4' is a partial cross sectional view similar to FIG. 4, but showing a constructional variation and in which for improved clarity some structional details are shown in phantom perspective;

FIG. 4'' is also a partial cross sectional view similar to FIG. 4', but showing still another constructional variation;

FIG. 5 is a partial cross sectional view similar to FIG. 1, but showing a door with a modified external design;

FIG. 6 is a cross sectional view taken along line 6—6 of FIG. 5, showing details of peripheral framing for the door;

FIG. 6' is a partial cross sectional view similar to FIG. 6, but showing a finishing detail of the peripheral framing, and FIG. 6'' is also a cross sectional view similar to FIG. 6', but showing a modified finishing detail.

In FIG. 1 the door of the present invention, generally designated 10, is in accordance with the present invention constructed so as to have a desirable external appearance of an entirely wooden article of manufacture although, in actual fact, it has a core of metal construction material which is merely faced with wood veneer or panels, or alternatively is surface painted to provide a wood appearance, all as will be subsequently described in detail. As generally understood in the trade, perceived as a solid wooden door it is considered a top of the line product from an appearance or aesthetic viewpoint, and having a metal core it structurally has corresponding high structural strength, non-warping and fire-resistance characteristics, as well as other noteworthy attributes.

As referred to subsequently herein, the simple surface-painted "basic" version is that designated 10 in FIG. 1, while that designated 10' will be understood to be also surface-painted to provide a wood appearance and additionally covered by wood veneer, wood panel inserts and moldings. Basic door 10 and the supplemented version door 10' can be made to suit standard or special construction dimensions, and with or without side panels (not shown) to match. The doors 10 and 10' can be made to have any of the available glass plate insert options and panel patterns presently iu use on conventional non-metal core doors.

Door 10 consists basically of a rectangular wood frame 12 fixedly sandwiched between identically formed metal stampings or body panels 14. Frame 12 consists of a pair of stiles 16 and a pair of rails 18. Lock blocks 20 are added to stiles 16 to support dead bolts and door-knob locks. Both left and right stiles 16 are provided as shown in FIG. 1 so that door 10 can be correspondingly mounted as either a left or right opening unit. Various other blocks 22 are provided to maintain spacing between the sheet metal body members 14 and/or to support mail slots, doorbells, peepholes or other optionally provided door accessories.

Members 14 are each formed of a light gauge, i.e. 23 gauge or the like, galvanized steel or other weather resistant metal construction material. Recesses 24 can be formed in members 14 to provide the appearance of shaped wood inserts, or alternatively shaped wood panels 26 with wood molding 28 are appropriately adhesively secured in covering relation over the basic door 10 in the locations illustrated in FIG. 1, and as shown in cross section in FIG. 4. Stated otherwise, for the veneer covered door 10' the shapes 30 are made as sheet metal imparted drawn right angle recesses, as best shown in FIG. 4'. When a deep draw 30 is not practical, basic body members 14 can alternatively be provided as flanged openings 32 (see FIG. 4'') and pan-like members 34 secured in these openings 32 along a seam 36 by spot welding or other suitable means. In either case, i.e., as deep drawn recesses or secured members in flanged openings, the structure described reinforces and stiffens the sheet metal body members 14, thus insuring and contributing to the enhanced structural strength and non-warping characteristics of the door 10 and 10'.

In the above regard, underlying the present invention is the recognition that while ordinarily thin gauge metal panels lack structural strength and rigidity to function as a core for an entry door, the sides extending laterally of the plane of the body panels 14 which bound the recesses 30 or the variation construction 34, do have the requisite strength and rigidity characteristics to provide this function, because of the resistance against bending or flexing which occurs at the fold lines along which the recess edges extend laterally of the flat plane of the body panels 14. The recesses 30 and/or secured pans 32 thus contribute rigidity to the door core panels 14 in the upper and lower medial areas of the door 10, 10'.

The relationship at the outside corners where members 14 are joined to frame 12 can be made in different ways. In the simplest arrangement, the frame 16 and 18 are made to have square outside corners and the edges of metal members 14 are cut to be flush with surface 48, as best shown in FIG. 6. In a variation as shown in FIG. 6', frame 12 has shaped outside corners 50 that allow for lips or interned laterally extending edges 52 on members 14 to rest thereon. This arrangement also allows for door 10 or door 10, to be notched to receive flush mounted hinge leafs, and serves to prevent the metal edges of members 14 from being easily lifted away from frame 12. As shown in FIG. 1, members 14 can be made with lips 52 along their vertical edges for assembly on stiles shaped as shown in FIG. 6', while the horizontal edges of members 14 are prepared and assembled as shown in FIG. 6. Yet another method of finishing the vertical edges of door 10 or 10' is to arrange for lips 52 to overlap square corners of frame 12 and then to be capped, or not, by a wood strip 54 as seen in FIG. 6''. This approach allows for hinge leaf notching and fit dressing if required as door 10 and 10'' is mounted.

Each of the above described frame finishing techniques is to be applied about the full perimeter or periphery of a given door, or to be applied in combination with each other. From the foregoing description, it should be obvious that the securing of the frame about the periphery of the body members 14 provides desirable peripheral rigidity to the completed assembly. It should nevertheless be noted that in circumstances where maximum peripheral rigidity is desired, it is again an underlying recognition of the present invention that in the FIG. 6'' configuration of the body members 14 that the inturned edges 52 provide a supplementing rigidity at the fold lines along which the edges 52 extend laterally of the plane of the body members 14 because at these fold line locations the sheet metal construction material of the body members resists bending and flexturing.

At a preliminary stage of assembly of the door 10 and 10', all components of frame 12 are advantageously properly located and glued to the inside surface of a selected one of the two members 14, using an appropriate adhesive or glue 38. One preferred type adhesive is 3M #1357 high performance glue. When glass panels are to be installed as part of the door suitable auxiliary framing 12' (FIG. 5 and 6) surrounding appropriately sized opening 40 is also glued to the selected member 14. At final assembly, glass panel 41 is secured with molding strips 43 applied about the perimeter of opening 40.

It is contemplated that in use that the interior space within frame 12, after the members 14 are assembled thereon, be filled with thermal insulation 44. It has been found that the introduction of expanded styrofoam pellets 44 or their equivalent is the most economical procedure for achieving thermal insulation. However, in reduced size or restricted areas, such as the space between back to back panels 24 or 30, the referred to pellets may not accumulate in a desired compactness or density. Therefore, it may be necessary to provide rigid sized and shaped pieces 46 of insulation board in appropriate spaces and to glue these in place on the selected members 14 (FIGS. 3, 4 and 4'). Alternatively space 42 can be filled completely with formed insulation blocks.

After all interior components have been arranged and glued to the selected member 14, adjoining surfaces of frame 12 and those of the other member 14 are prepared and glued to seal the shell of basic door 10. In the case where pellet insulation is to be installed in space 42, one or more access holes 56 are made in frame 12. The use of one or more holes 56 allows for air pressure delivery of expanded insulation pellets throughout space 42, after which these access holes are sealed with plugs 58. To complete the door assembly, if required by weather conditions, grooves or inserts 60 as shown in FIG. 4 may be made in peripheral surfaces 48 of frame 12 and would receive weatherstripping or the like.

If a basic door 10 is to be fabricated from the assembled core panels 14, the external surface is painted to simulate the appearance of a wood door. If the appearance-enhanced door version 10' is intended and the core thereof includes the panel-shaped recesses 30 of FIG. 4', to provide a better simulation of a wooden top of the line door, use is made of adhesively secured wood veneer strips 62, contoured wood inserts 64, and appropriate molding 66, all glued in place, and the door 10' then completed with a finish coat.

While the door constructions herein shown and disclosed in detail are fully capable of attaining the objects and provided the advantages hereinbefore stated, it is to be understood that they are merely illustrative of the presently preferred embodiments of the invention and that no limitations are intended to the detail of construction or design herein shown other than as defined in the appended claims.

What is claimed is:

1. A wood-surfaced door formed of a metal core comprising a cooperating pair of rectangular facing body panels each of thin gauge sheet metal construction material, each said body panel having top, bottom and opposite side edges folded laterally thereof along fold lines correspondingly located along said top, bottom and opposite sides of each said body panel to contribute peripheral area rigidity to said body panel along said fold lines, four rectangular recesses in top and bottom areas of each said body panel, each said rectangular recess being bounded by four edges folded inwardly ninety degrees laterally of the plane of said body panel to form fold lines adapted to contribute along said fold lines a resistance to bending providing medial area rigidity to each said body panel, a frame having an operative position disposed along the top, bottom and opposite sides of said rectangular sheet metal body panels to contribute to the rigidity of the peripheral area of said door, and plural wood panels adhesively secured in covering relation over an exterior surface of each said core body panel, whereby the external appearance of said core door body panel is of a wood article of manufacture.

* * * * *